US006547234B1

(12) United States Patent
Quesnel

(10) Patent No.: US 6,547,234 B1
(45) Date of Patent: Apr. 15, 2003

(54) QUADRUPLE CAPACITY FEEDER CASSETTE

(75) Inventor: Lisbeth S. Quesnel, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 45 days.

(21) Appl. No.: 09/962,479

(22) Filed: Sep. 24, 2001

(51) Int. Cl.[7] ..... B65H 3/44

(52) U.S. Cl. ..... 271/9.08; 271/9.03; 271/9.07; 221/11; 221/197

(58) Field of Search ..... 221/11, 14, 17, 221/65, 197; 271/9.03, 9.07, 9.08

(56) References Cited

FOREIGN PATENT DOCUMENTS

JP 03223037 A * 10/1991 ..... B65H/3/44
JP 04028634 A * 1/1992 ..... B65H/1/28
JP 04101934 A * 4/1992 ..... B65H/1/30

* cited by examiner

*Primary Examiner*—Donald P. Walsh
*Assistant Examiner*—Kaitlin Joerger
(74) *Attorney, Agent, or Firm*—Perman & Green, LLP

(57) ABSTRACT

A sheet feed cassette adapted to be installed within a sheet feed unit of an image forming apparatus such as, for example, a copier as a printer. The cassette includes a frame including at least a side frame and a bottom frame. A bottom plate is provided above the bottom frame including collapsible guide walls for positioning four separate stacks of sheets within the cassette on the plate. Each of the walls are adapted to collapse thereby allowing each of the four stacks of sheets individually to be moved within the cassette to be in contiguous relation to a feeder unit for feeding individual sheets from a single stack of sheets that is positioned within the cassette into the apparatus. A feeding device moves each of the four stacks from different positions within the cassette to the feeder unit so that individual sheets can be fed to the apparatus for each of the four stacks.

17 Claims, 7 Drawing Sheets

QUADRUPLE CAPACITY FEEDER CASSETTE

BACKGROUND OF THE INVENTION

1. Field of the Invention

The invention relates to a sheet feed cassette that is installed within a sheet feeder system of an image forming apparatus such as a printer, e.g. a laser printer or a copier, e.g. a xerographic copying apparatus, that is used to feed and forward sheets toward the image transfer section of such apparatus one by one. More particularly, the invention is directed to a single sheet feed quadruple cassette capable of holding and feeding up to four separate reams (stacks) of paper, and is also directed to a method for feeding up to four separate reams (stacks) of paper from a single cassette.

2. Description of the Prior Art

Generally speaking, the process of electrostatographic reproduction can be employed in a printer or a copier and basically includes initially charging a photoconductive member to a substantially uniform potential so as to sensitize the surface thereof. A charged portion of the photoconductive surface is then exposed at an exposure station to a light image of an original document that is to be reproduced. Typically, an original document that is to be reproduced is placed in registration, either manually or by means of an automatic document handler, on a platen for such exposure.

By exposing an image of an original document as such at the exposure station, there is recorded an electrostatic latent image of the original image onto the photoconductive member. The recorded latent image is subsequently developed using a developmental apparatus by bringing a charged dry or liquid developer material into contact with the latent image. Two component and single component developer materials are commonly used. A typical two-component dry developer material has magnetic carrier granules with fusible toner particles adhering triobelectrically thereto. A single component dry developer material that typically comprises toner particles only can also be used. The toner image formed by such a development process is subsequently transferred at a transfer station onto a copy sheet fed to such transfer station. The toner particles image on the copy sheet is then heated and permanently fused so as to form a "hardcopy" of the original image. The copy sheet typically is then fed from a copy sheet supply that can be an elaborate and expensive elevator assembly, or a relatively less costly cassette tray assembly, such as for example, a forward feed buckle cassette tray assembly. There are several different structures for cassette tray assemblies known in the art. Examples of some of these different structures are illustrated in the following U.S. Patents:

U.S. Pat. No. 5,224,693 describes a copying machine including a paper feeding device that has a paper feeding cassette which can be divided into first and second trays in tandem in a paper feeding direction within the copying machine body. The paper feeding device also has several feeding trays vertically stacked with regard to each other.

U.S. Pat. No. 5,102,112 describes a paper feeding cassette that is divided into two paper sections that are in tandem to one another.

U.S. Pat. No. 5,405,128 illustrates a sheet feed device having a tray provided with two sheet storing portions adjoining each other serially in the direction of sheet feed. Sheet feeding and separating means are both associated with each of t he sheet storing portions to direct the sheets one by one to a copier. A transport device drives the sheet fed out from the rear storing portion of a tray to a vertical transport path.

One of the most important and significant advantages that one printer can have over another printer, or that one xerographic copier can have over another xerographic copier, is a larger paper feeder capacity. This is a significant feature at all price levels of printers/copiers. Typically, a single cassette holds one ream of #20 paper. A standard midvolume machine has 4 cassettes and can therefore hold up to four (4) reams of paper (e.g. #20 paper). Additional sheet capacity is obtained by the use of an attached high capacity feeder module. However, these separate paper feeder modules which supply extra paper to the copier/printer have the disadvantage of being relatively expensive, and very bulky. They also require a good deal of space when added to a copier/printer. Currently available to try to overcome this disadvantage, are tandem cassettes, which hold two (2) reams of paper. These are loaded in a long edge feed direction. When all the paper in the first stack has been used, the second stack is moved into feed position.

It is a primary objective of the present invention to overcome all of the disadvantages referred to above in a paper supply cassette for use in a printer or copier apparatus.

SUMMARY OF THE INVENTION

In accordance with the features of the present invention there is provided a quadruple capacity cassette structure which eliminates all of the basic disadvantages referred to above, and provides at a reasonable cost and within a reasonable amount of space a sheet feed cassette for an apparatus such as a printer or a copier, that is adapted to be installed within a sheet feed unit of an image forming apparatus and feed a very large volume of paper to the apparatus. The cassette structure comprises a frame including at least a side frame and a bottom frame; a bottom plate provided above the bottom frame including collapsible guide walls for positioning four separate stacks of sheets within the cassette, each of the walls adapted to collapse thereby allowing each of the four stacks to be moved within the cassette to a position in contiguous relation to a feeder unit for feeding individual sheets from a single stack of sheets positioned within the cassette into the apparatus; and a feeding device to move each of the four stacks from different positions within the cassette to a position in contiguous relation to the feeder unit so that individual sheets can be fed to the apparatus from each of the four stacks.

In accordance with additional features of the present invention there is provided a method for feeding sheets from separate stacks of sheets positioned in a cassette, the cassette being adapted to be installed within a sheet feed unit of an image forming apparatus. The method comprises the steps of: (a) positioning four separate stacks of sheets within areas of the cassette having collapsible guide walls; (b) collapsing some of the guide walls in a timed relationship whereby each of the four separate stacks is free to move within the cassette towards the sheet feeder unit; (c) moving each of the four stacks in a timed relationship so that each stack is positioned in a contiguous relation to a sheet feeder unit for feeding individual sheets from a single stack of sheets; (d) feeding a sheet one at a time from each of the stacks to the apparatus as each stack is positioned at the feeder unit.

Furthermore in accordance with additional features of the present invention there is provided a method for feeding sheets from four separate stacks of sheets positioned in a cassette and separated by collapsible walls, the cassette being adapted to be installed within a sheet feed unit of an image forming apparatus. The method comprises the steps of: (a) positioning a first stack of sheets within the cassette whereby sheets can be fed by a feeder unit into the apparatus; (b) collapsing a wall separating the first stack of sheets from a second stack of sheets; (c) moving the second stack of sheets within the cassette whereby sheets from the second stack can be fed by the feeder unit into the apparatus; (d) collapsing a wall separating a third stack of sheets from the original position of the first stacks of sheets; (e) moving the third stack of sheets within the cassette whereby sheets from the third stacks can be fed by the feeder unit into the apparatus; (f) collapsing a wall separating a fourth stack of sheets from the original position of the second stack of sheets; and (g) moving the fourth stack of sheets within the cassette whereby sheets from the fourth stack of sheets can be fed by the feeder unit into the apparatus.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

While the present invention will be described in connection with a preferred embodiment thereof, it will be understood that is not intended to limit the invention to that embodiment. On the contrary, the present invention is intended to cover all alternatives, modifications, and equivalents as may be included within the spirit and scope of the features of the invention as defined by the appended claims.

Figure 1:
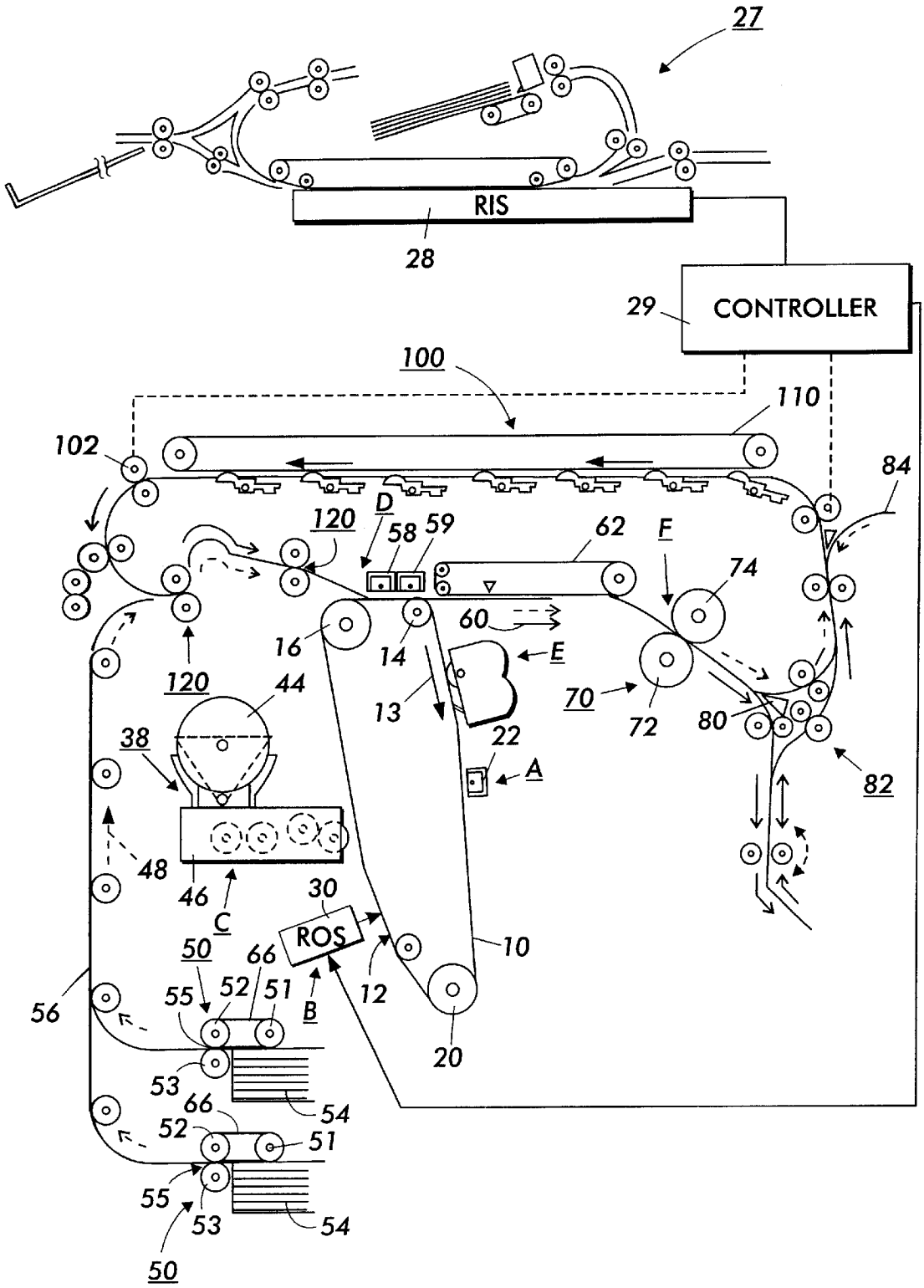
FIG. 1 is a plan elevation view of a typical electrophotographic printing machine that can employ the features of the quadruple cassette structure in accordance with the present invention.

For a general understanding of the features of the present invention, reference is made to the drawings. In the drawings, like reference numerals have been used throughout to identify identical elements. FIG. 1 schematically depicts an electrophotographic printing machine that can incorporate therein the features of the sheet feed cassette of the present invention. It will become evident from the following discussion that the structure for a cassette as defined by the present invention may be employed in a wide variety of cassettes used for example, in copiers or printers, and is not specifically limited in its application to the particular embodiment depicted herein.

Referring now to FIG. 1 of the drawings, an original document is positioned in a document handler 27 on a raster input scanner (RIS) indicated generally by reference numeral 28. The RIS apparatus contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) as described below.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 20 and drive roller 16. As roller 16 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference number 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a nudger roll 51 which feeds the uppermost sheet of stack 54 to nip 55 formed by feed roll 52 and retard roll 53. A belt 66 is included between rollers 51 and 52 to move a top sheet from a stack (ream) 54 of paper in a cassette tray. Feed roll 52 rotates to advance the sheet from stack 54 into vertical transport 56. Stack 54 can be positioned in a cassette in accordance with the features of the present invention which can support up to four individual stacks 54 of paper in a single cassette as described herein below. As illustrated in FIG. 1 the xerographic copying apparatus can, for example, include two cassettes having the features of the present invention so that up to eight reams of paper, i.e. eight individual stacks 54 can be positioned for feeding to a xerographic copier. Vertical transport 56 directs the advancing sheet 48 of support material into the registration transport 120 using an the array sensor past image transfer station D to receive an image from photoconductive belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 84 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transport 110, for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions herein before described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
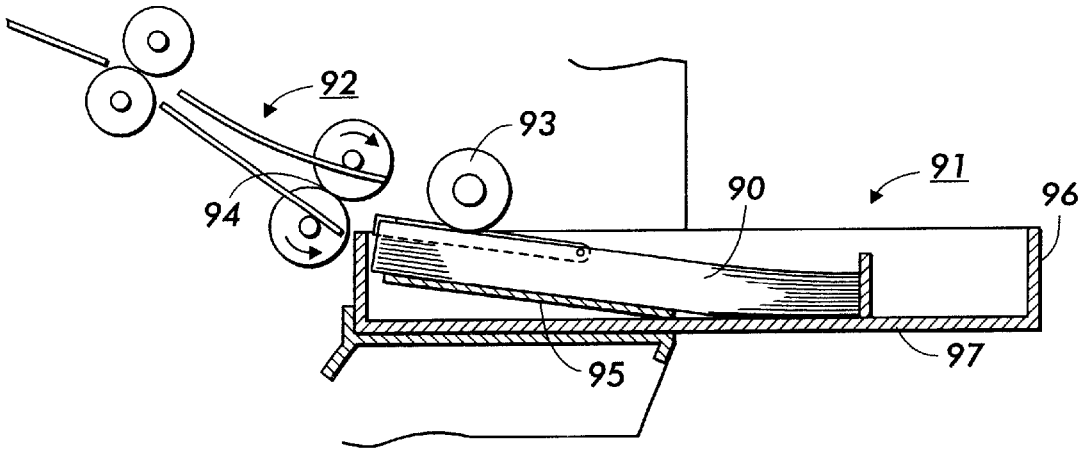
FIG. 2 is a cross sectional view of a typical example of a prior art structure for a cassette holding a single stack of paper.

An example of a conventional cassette typical of known cassettes for conventional reproducing machines is illustrated in FIG. 2. The cassette is arranged as shown wherein paper sheets 90 contained in cassette 91 are sent one by one into a sending passage 92 leading to a reproducing apparatus (not shown). The sheets are supplied by way of a feed roll 93 while being limited to one sheet at a time by a sheet separation wip 94. The paper sheets 90 in the cassette 91 are supported on a bottom plate 95. The paper sheets can be fed in an upward direction to feed roll 93 by an elevator system (not shown). The cassette structure 91 is basically formed of a frame including at least a side frame 96 and a bottom frame 97. The cassette structure just described is a typical example of known standard cassette structures typically used for supplying paper to a copying apparatus which employ one ream (stack) of paper at a time. When a stack of paper has been used, the user must refill the cassette with more paper.

It should be noted that a standard cassette structure or a quadruple cassette in accordance with the features of the present invention can be slidingly mountable on a pair of guide rails positioned on the main printing apparatus as the cassette is inserted into the sheet supply cavity from the side of a printer or a copying machine. The guide rails are each mounted at opposite ends to parallel apparatus frame members and the cassette is inserted until a stop member on the guide rail interrupts further travel of the cassette onto the guide rails by engaging the stop member of the cassette.

A quadruple cassette in accordance with the present invention generally comprises a box-like configuration with the sheet holding cavities surrounded by walls, it being noted that the height of a front positioned wall is generally lower than the remaining walls to enable feeding a sheet thereover. The sheet stack supply platform of the stack which feeds sheets to the copier/printer apparatus can be urged upwardly by an elevator mechanism so that the sheet supply is raised above the height of the forward wall at the front end of the cassette. The cassette structure generally includes corner snubbers (not shown) arranged to ride on the corners of a stack of sheets inhibiting the forward motion of the corners of the sheets when the sheet is fed in the forward position. The snubbers also inhibit upward motion of the stack of sheets to position the top sheet of a stack in correct position for feeding and to keep the elevator system from biasing the stack against feed rolls when not feeding.

The basic concept of the quadruple cassette feeder in accordance with the present invention is that it effectively employs all usable space within the printer/copier, thereby dramatically increasing the paper capacity. The quadruple cassette can be used for standalone machines that have under-IOT (input output terminal) cassettes, above-head cassettes, and also has potential use in high capacity feeders, which are modular paper feeder units found typically on the side of the machine. The quadruple cassette feeder can replace some of the smaller high capacity feeders which store six (6) reams of paper, by setting the max height of the stacks at 1.5 reams per. The quadruple cassette feeder is particularly useful for markets (e.g. limited office space) which have limited room to install side mounted high capacity feeders. More importantly this is a much less expensive alternative to a separate high capacity feeder unit. In the absence of a side mounted high capacity feeder paper, stacks 3 & 4 of the four stacks in accordance with the features of the present invention can easily be pulled out (requires separate sub-tray), to be loaded with paper while stack 1 is feeding. Stack position 2 can be loaded from the front while in run mode.

Although it may typically be used to place four single reams of paper within a cassette, it can also be used for multiple reams in each of the four locations. In other words, it is not restricted to one ream per stack position.

The enabling features in accordance with the features of the present invention are (1) collapsible side wall guides and (2) pushers which are driven by various standard drive mechanisms. These collapsible side wall guides store in recesses when the replacement stack of paper is moving into position. The guides can be actuated with solenoids or small motors, with return mechanisms being either springs or motors, respectively. The location of the side guides are usually in between stacks 1 & 3 and 2 & 4; however, these guides can be between stacks 1 & 2. The side guide for stack 1 swivels or pivots out of the way. The side guide for stack 2 remains fixed. The pushers (i.e. devices that move the stacks 1, 2, 3, or 4) are attached to the drive mechanisms which can rotate in both directions, delivering stacks to be fed and then returning them to "home" position. The drive mechanisms depicted are only an example of the type of drive mechanisms that can be used to move the stacks and/or guide members.

The sequence of events regarding movement of the stacks can also vary. For example, after stack 1 is empty, stack 3 can move into position. The standard method would be to empty stack 1, then 2, then move 3 and 4 into position; however, the features of the present invention are not necessarily limited to this specific movement arrangement.

Figure 3:
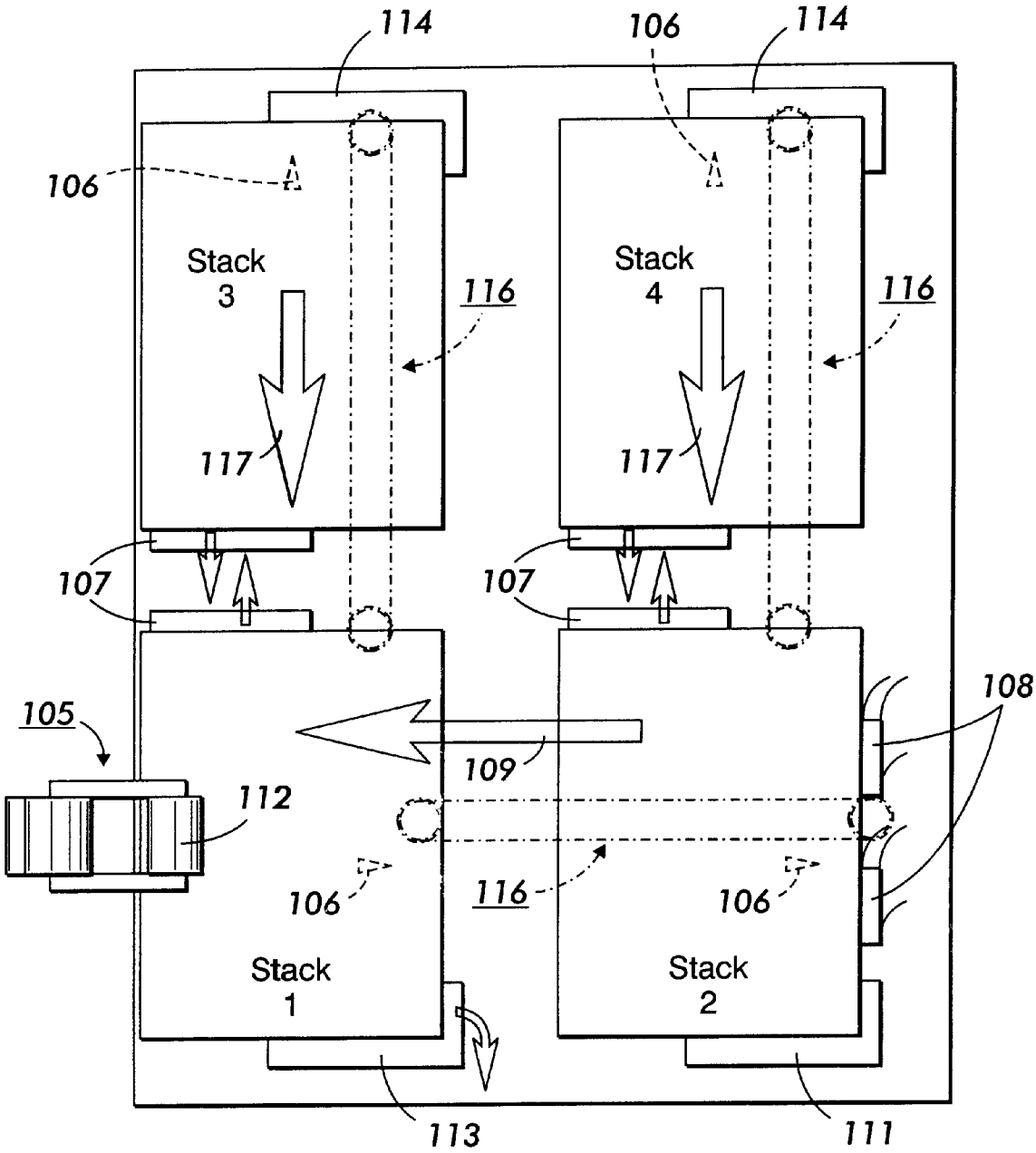
FIG. 3 is a top plan schematic cross sectional view of a typical quadruple cassette configuration in accordance with the features of the present invention illustrating paper stack movement as each of four stacks of paper are used in a single cassette, and also the movement of the various pivotable guide walls.

In accordance with the features of the present invention there is a general sequence of events that occur with regard to the loading and feeding of four paper stacks from a quadruple cassette to an apparatus such as a printer or a copier. Firstly, the four stack positions, 1, 2, 3 and 4 within a quadruple cassette feeder are loaded with stacks (reams) of paper as illustrated in FIG. 3. The paper in stack 1 is first fed by feedhead 105 to a printer or copier apparatus (not shown). Stack 1 of paper is first depleted and thereafter the stack 1 empty sensor 106 is then activated. This information is relayed to an apparatus controller such as controller 29 as illustrated in FIG. 1. At the completion of feeding all the paper from stack 1, feeder nudger roller 112 lifts up. In fact, at the completion of each individual sheet feed, the feeder nudger roller 112 lifts up. At the completion of feeding all the paper from stack one, the machine user receives a message on the user interface, such as, for example, "STACK 2 LOADING NOW". Pivotable slide guide 107 for stack 1, located by stack 1 are pivoted out of the way, i.e. rotating in a clockwise direction. Several different mechanisms can be used for achieving this movement such as, for example, a standard motor and four bar linkage, rocker style.

Thereafter pushers 108 for stack 2 are activated and move stack 2 in the direction of arrow 109 so that stack 2 is now in the same original position of stack 1 in position by feedhead 105 so that the paper sheets in stack 2 can then be fed to the printer or copier. Side guide 111 for stack 2 remains in place during movement of stack 2. Also the collapsible side wall 107 for stack 2 remains in position at this time, i.e. does not collapse. The stack empty sensor 106 for stack 2 is activated and this information is sent to the apparatus controller 29. Pivotable side guide 113 for stack 1 pivots back into position to be able to guide a stack of paper. At this juncture, there is a stack of paper in stack positions 1, 3 and 4. The pushers 108 for stack 2 now return to their home position. The paper now in stack 1 (i.e. the paper originally from stack position 2) is now fed by feeder 105 to the apparatus until depleted. At the completion of each sheet feed the nudger roll 112 lifts up. Once all the paper presently in stack 1 has been fed to the printer or copier apparatus and the stack is empty the stack 1 empty sensor 106 is activated and this information is relayed to the machine controller 29. Also at this time the stack 2 empty sensor 106 is also activated so the controller 29 now knows that the only available paper is positioned in stack 3 and in stack 4. All the collapsible side guides 107 are now rotated in a downward direction so as to be positioned in self-storing recesses located in the bottom portion of the cassette structure (not shown). This is preferably accomplished by activating a standard rotating shaft onto which side guides 107 are attached (not shown). All four side guides 107 can be attached to the same shaft, which spans across the gap between stacks positions 1 & 3 and 2 & 4, or alternatively several distinct shafts can be used. The pusher members 114 for the stacks of paper in stack positions 3 & 4 (which are used to advance stacks of paper from stack positions 3 & 4 to stack positions 1 & 2 respectively) now to their "home" position. The four pivotable side guides 107 are now rotated so that they are each positioned out of the way in their respective self-storing recesses. At this juncture the pusher member 108 for stack 2, the stationary side guide 111 for stack 2 and the pivotable side guide 113 for stack 1 are all in their "home" positions. Thereafter, the pusher members 114 for stack 3 and stack 4 are engaged, the transport mechanism 116 rotates and stack pusher members 114 move in the direction of arrows 117, pushing stacks of paper 3 and 4 into stack positions 1 and 2 respectively. Stack pusher members 114 move in slotted grooves located in the bottom of the cassette (not shown). The user of the apparatus at this time receives a message on the user interface that informs the user that stacks 3 & 4 are being loaded.

Both sensors 106 for stacks 3 and 4 are activated. The paper feeder 105 then feeds all paper originally from stack 3 and now in stack 1. When all the paper originally from stack 3 has been fed from stack 1 the paper originally from stack 4 and now in stack 2 is moved to stack 1 in the same manner as described herein above. When the stack 2 paper is moved to the stack 1 position it is fed to the printer or copier by the feedhead 105. Thus, all the paper originally in the stack 4 is fed to the apparatus.

Figure 4:
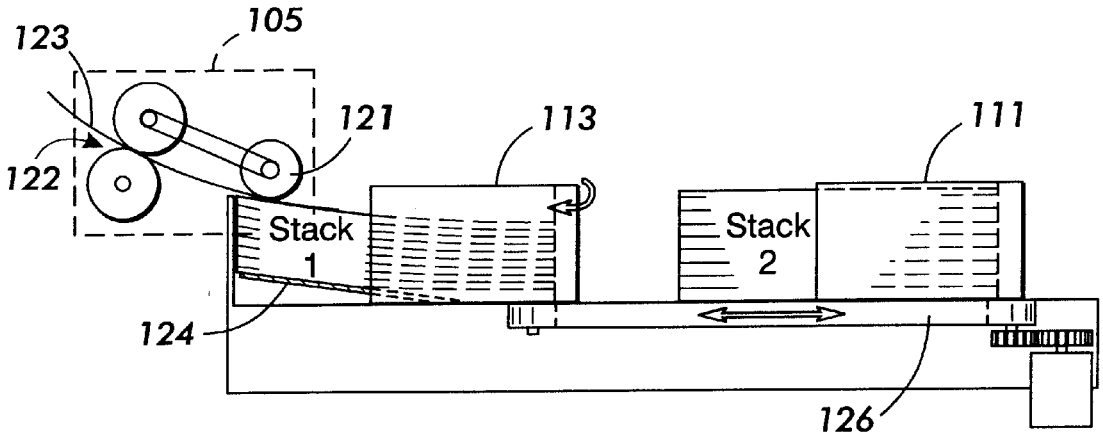
FIG. 4 is a side plan cross sectional schematic view taken along stacks 1 and 2 of FIG. 3 illustrating the feeding of sheets from stack 1 to the printer or copier apparatus.
Figure 5:
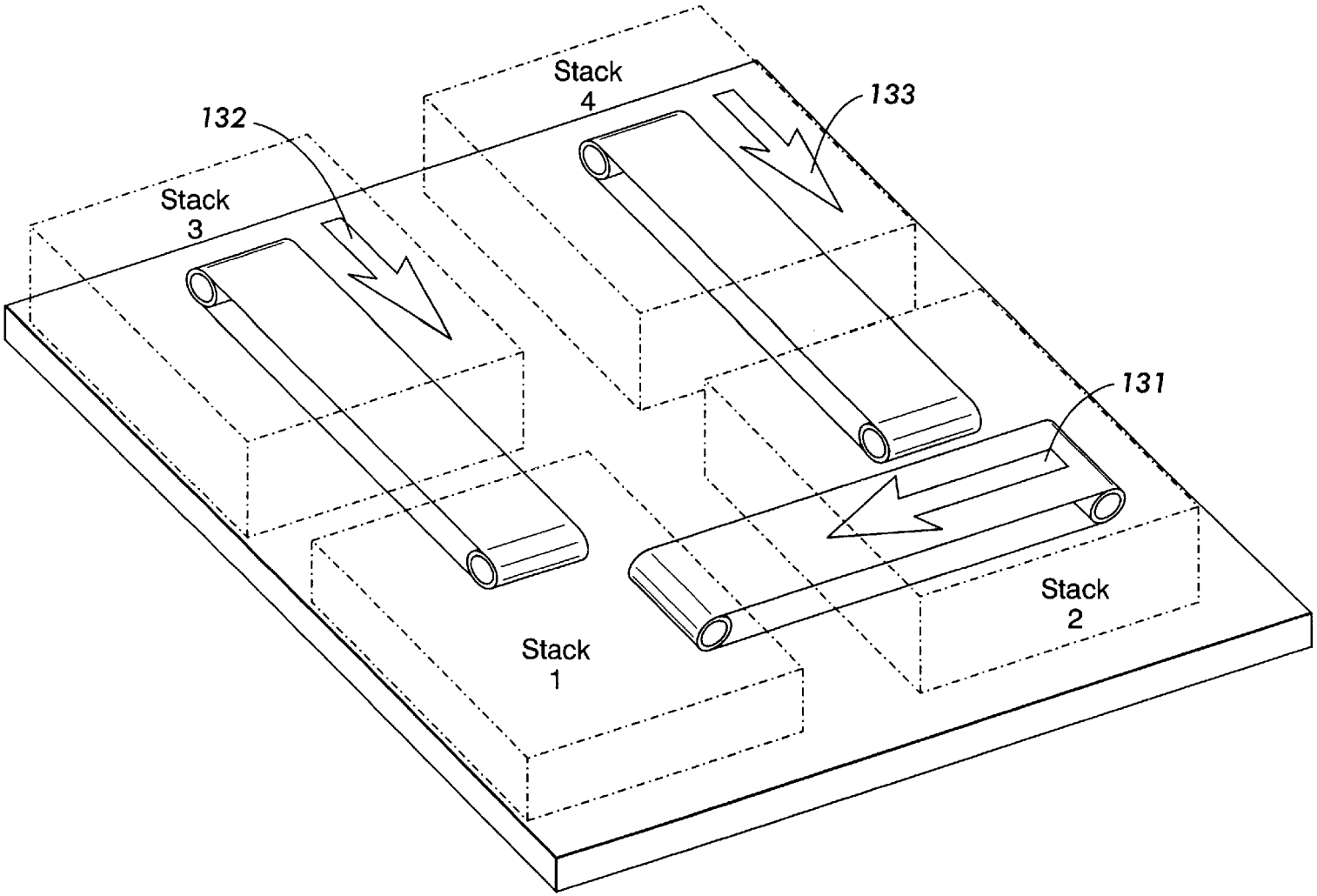
FIG. 5 is a perspective view illustrating a typical belt type transport mechanism used for moving the various sheet stacks in accordance with the features of the present invention.

FIG. 4 illustrates a schematic representation of the paper path for stacks 1 and 2 of FIG. 3. Of course, in accordance with the embodiment of the present invention described above, the stacks of paper shown in FIG. 4 could also be original stacks 3 & 4 which have been moved into the positions of stacks 1 & 2 by pusher members 114. As illustrated the feedhead 105 includes a feeder nudger roller 121 which lifts in an upward movement after each sheet is fed to the printer or copier apparatus. Included as part of the feedhead 105 is a feeder separation nip 122 formed of a pair of rolls which allow only one sheet of paper 123 to be fed at one time to the printer or copier apparatus. Also shown as part of the paper feed mechanism is an elevator system 124 positioned under stack 1 for applying a force against the top paper sheet in stack 1 and feeder nudger roller 121 for feeding the sheet of paper to the feeder separation nip 122 and to the printer or copier apparatus. Also illustrated in FIG. 4 is the positioning of stacks 1 and 2 and side guides 111 and 113. Side guide 113 for stack 1 (as also shown in FIG. 3) pivots out of the way when the paper in stack 2 advances into position to be fed by feedhead 105. Side guide 111 is stationary and remains in place. The transport mechanism 126 that can be used to move the various stacks of paper and to move the various pivotable walls can be a belt transport system or can be a rack and pinion system with rack attached and fixed to pusher members or, for example, a worm gear arrangement. This mechanism is used to move stack 2 to the position of stack 1, and also to move the paper in stacks 3 & 4 to the positions of stacks 1 & 2 respectively. FIG. 5 illustrates a schematic representation of a typical transport mechanism in the form of a belt drive for moving paper from the stack 2 position to the stack 1 position (arrow 131), and also the movement of stack 3 to the stack 1 (arrow 132) position and the movement of stack 4 to the stack 2 position (arrow 133).

Figure 6:
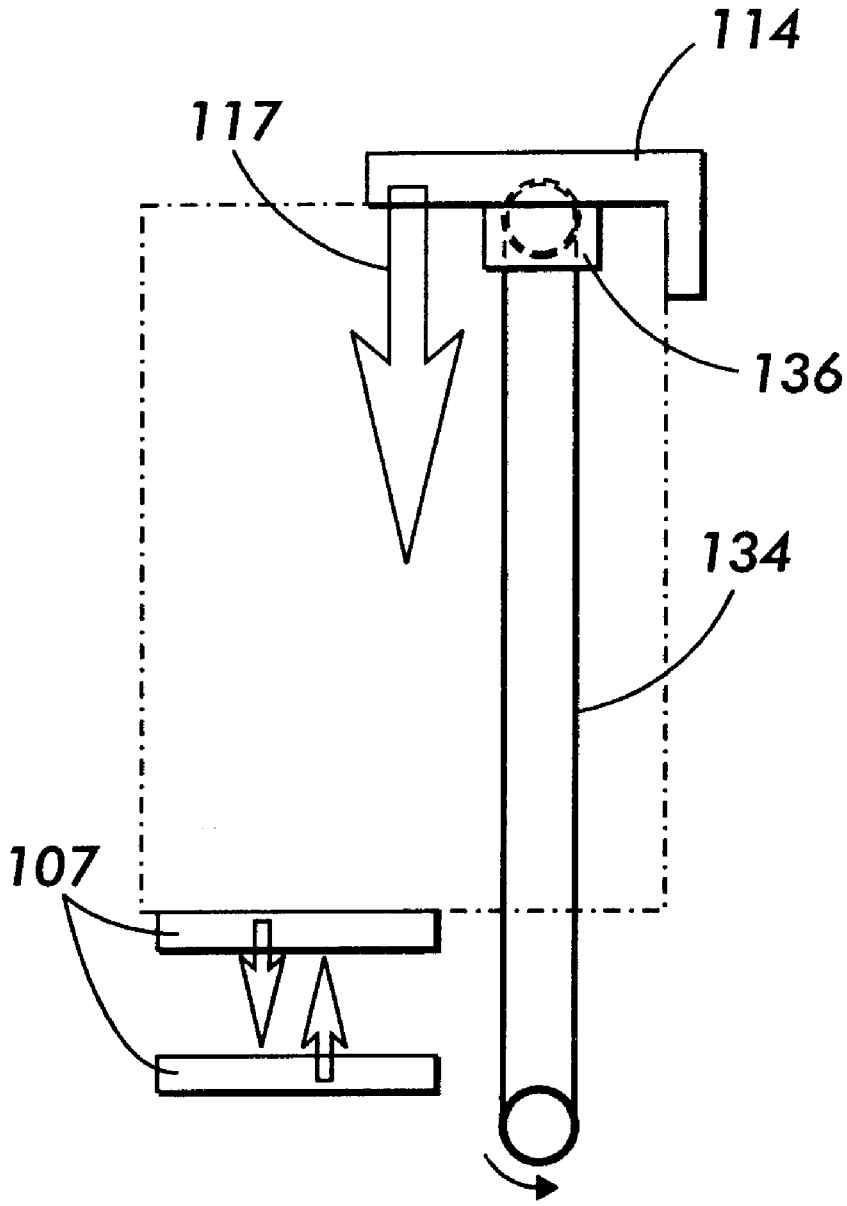
FIG. 6 is a plan cross sectional schematic view illustrating details of a pusher member in accordance with the features of the present invention.

FIG. 6 illustrates an example of the details of a pusher member (such as pusher member 114 which moves stack 3—See FIG. 3). The rotation of pulley belt 134 causes the movement of stack 3 pusher member 114 in the direction of arrow 117. The quadruple cassette tray in accordance with the features of this invention is slotted (not shown) so that pusher member 114 via its pusher connector 136 can advance in a straight forward movement within a slot when the drive mechanism is engaged. The pulley 134 is driven by a motor; a typical drive scheme would be a double gear to an offset motor (not shown). The stack pusher member 114 is attached to pulley belt 134 via connector piece 136 which includes a few rack-type grooves. The pusher member 114 via its connector piece 136 moves within a cassette slot when pulley belt 134 rotates. Pivotable side walls 107 for stacks 3 and 1 are preferably moved (pivoted) by securing these side walls to a shaft (not shown) which when rotated rotates each of side walls 107 in a downward direction into their self-storing recess (not shown). These pivotable side walls 107 are positioned on the cassette structure offset from pusher member 114 so that they do not interfere with each other during their respective movement. The connector piece 136 attaches to belt 134 via mating grooves so that pusher member 114 can be driven in a straight and forward direction when belt 134 rotates.

Figure 7A:
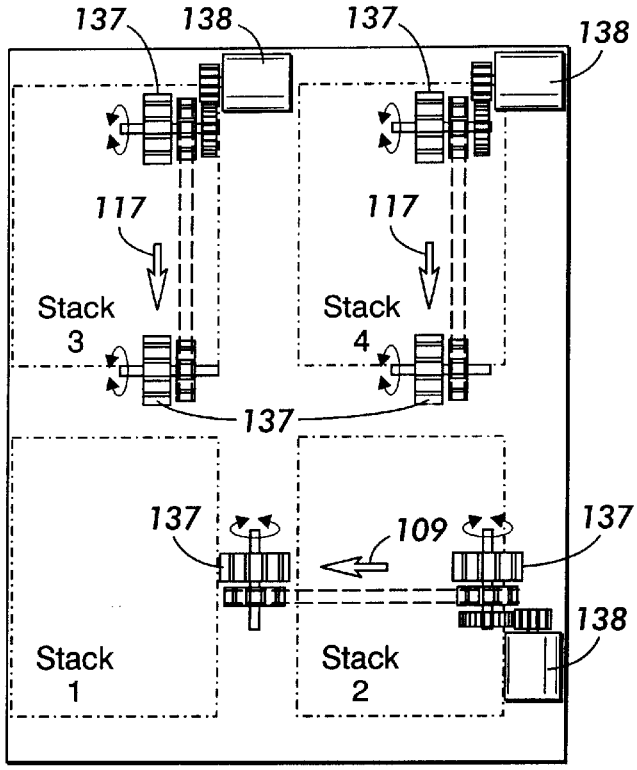
FIGS. 7A and 7B illustrate top plan views of examples of transport driving mechanisms for use with the quadruple cassette in accordance with the features of the present invention, i.e. 7A (rack and pinion drive) and 7B (warm gear drive mechanism).
Figure 7B:
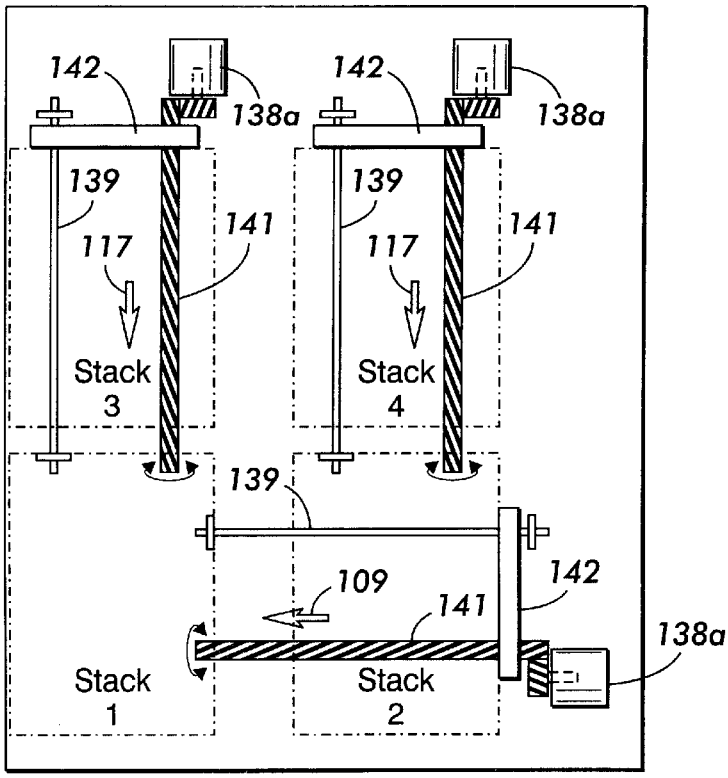

FIGS. 7A and 7B illustrate examples of various drive mechanisms that can be positioned on the bottom portion of the quadruple cassette in accordance with the features of the present invention for moving both the pusher members and pivotable side walls as described herein. As illustrated in FIG. 7A there is shown an example of a series of pinions 137 for a rack and pinion drive system that could be positioned on the bottom portion of a quadruple cassette in accordance with the features of the present invention. Each drive system is driven by a motor 138. FIG. 7B illustrates another embodiment of a drive mechanism for a quadruple cassette structure in accordance with the present invention. As shown a guide shaft 139 is used with a worm gear mechanism 141 driven by motor 138a. A worm gear nut attaches to the bottom of the cassette tray. Guide rod 14, is internally threaded at a contact point with the warm gear. As the worm gear rotates the stacks of paper advance to their next position.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A sheet feed cassette adapted to be installed within a sheet feed unit of an image forming apparatus comprising:

a frame including at least a side frame and a bottom frame;

a bottom plate provided above the bottom frame including collapsible guide walls for positioning four separate stacks of sheets within the cassette on the plate, each of the walls adapted to collapse thereby allowing each of the four stacks individually to be moved within the cassette to be in contiguous relation to a feeder unit for feeding individual sheets from a single stack of sheets positioned within the cassette into the apparatus; and a feeding device adapted to move each of the four stacks from different positions within the cassette to a position in contiguous relation to the feeder unit so that individual sheets can be fed to the apparatus from each of the four stacks.

2. A sheet feed cassette according to claim 1 wherein said image forming apparatus is a copier.

3. A sheet feed cassette according to claim 1 wherein said image forming apparatus is a printer.

4. The sheet feed cassette according to claim 1, further comprising a stopper member for regulating the elevation of said bottom plate.

5. The sheet feed cassette according to claim 1, further comprising a roller member acting as a pinch roller of a forward roller unit in the image forming apparatus.

6. The sheet feed cassette, according to claim 1, wherein said feeding device includes a plurality of pusher members.

7. The sheet feed cassette according to claim 6 further including a plurality of guide wall members for guiding the movement of each of the said four stacks.

8. The sheet feed cassette according to claim 7 wherein at least one of said guide wall members is a stationary member and at least one of said guide wall members is pivotable.

9. The sheet feed cassette according to claim 1 wherein movement of said feeding device is actuated by a motor in combination with a rack and pinion system.

10. The sheet feed cassette according to claim 1 wherein movement of said feeding device is actuated by a motor in combination with a worm gear system.

11. A method for feeding sheets from separate stacks of sheets positioned in a cassette, the cassette being adapted to be installed within a sheet feed unit of an image forming apparatus, comprising the steps of (a) positioning four separate stacks of sheets within different areas of the cassette, the stacks being separated by collapsible guide walls, (b) collapsing the walls in a timed relationship whereby each of the four separate stacks is free to move within the cassette towards said sheet feeder unit;

(c) moving each of the four stacks in a timed relationship so that each stack is positioned in a contiguous relation to a sheet feeder unit for feeding individual sheets from a single stack of sheets; and (d) feeding a sheet from each of the stacks to the apparatus as each stack is positioned at said feeder unit.

12. A method for feeding sheets from four separate stacks of sheets positioned in a sheet feeding cassette and separated by collapsible guide walls, the cassette being adapted to be installed within a sheet feed unit of an image forming apparatus comprising:

(a) positioning a first stack of sheets within the cassette whereby individual sheets in the stack can be fed by a feeder unit into the apparatus;

(b) collapsing a wall separating the first stack of sheets from a second stack of sheets;

(c) moving the second stack of sheets within the cassette whereby sheets from the second stack can be fed by the feeder unit into the apparatus;

(d) collapsing a wall separating a third stack of sheets from the original position of the first stack of sheets;

(e) moving the third stack of sheets within the cassette to a position whereby sheets from the third stack can be fed by the feeder unit into the apparatus;

(f) collapsing a wall separating a forth stack of sheets from the original position of the second stack of sheets; and (g) moving the fourth stack of sheets within the cassette to a position in contiguous relation to the feeder unit whereby sheets from the fourth stack of sheets can be fed by the feeder unit into the apparatus.

13. A method for feeding sheets in accordance with claim 12 wherein said sheets are fed one at a time by said feeder unit to said apparatus.

14. A method for feeding sheets in accordance with claim 12 wherein said second stack of sheets is moved to said feeder unit after said first stack of sheets has fed all of its sheets to said apparatus.

15. A method for feeding sheets in accordance with claim 12 wherein said third stack of sheets is moved to said feeder unit after said second stack of sheets has fed all of its sheets to said apparatus.

16. A method for feeding sheets in accordance with claim 12 wherein said fourth stack of sheets is moved to said feeder unit after said third stack of sheets has fed all of its sheets to said apparatus.

17. A method for feeding sheets in accordance with claim 12 wherein the moving of said first, second, third and fourth stacks of sheets and the collapsing of said walls are all in timed relationship to the feeding of sheets to said apparatus.

* * * * *